US011229572B1

(12) United States Patent
Iku

(10) Patent No.: US 11,229,572 B1
(45) Date of Patent: Jan. 25, 2022

(54) ADJUSTABLE THERAPIST TABLE

(71) Applicant: Chima Iku, Bowie, MD (US)

(72) Inventor: Chima Iku, Bowie, MD (US)

( * ) Notice: Subject to any disclaimer, the term of this patent is extended or adjusted under 35 U.S.C. 154(b) by 0 days.

(21) Appl. No.: 17/087,707

(22) Filed: Nov. 3, 2020

(51) Int. Cl.

| | |
|---|---|
| ***A61G 13/12*** | (2006.01) |
| ***A61G 13/00*** | (2006.01) |
| ***A61G 5/00*** | (2006.01) |
| ***A61G 13/04*** | (2006.01) |

(52) U.S. Cl.
CPC ..... *A61G 13/1265* (2013.01); *A61G 5/006* (2013.01); *A61G 13/009* (2013.01); *A61G 13/04* (2013.01); *A61G 13/1225* (2013.01)

(58) Field of Classification Search
CPC ..... A61G 7/08; A61G 7/10; A61G 7/1021; A61G 7/005; A61G 13/12; A61G 13/1265; A61G 5/00; A61G 5/006; A61G 13/1225
See application file for complete search history.

(56) References Cited

U.S. PATENT DOCUMENTS

| | | | | |
|---|---|---|---|---|
| 4,937,901 | A | 7/1990 | Brennan | |
| D434,151 | S | 11/2000 | Fanuzzi | |
| 6,360,386 | B1 | 3/2002 | Chuang | |
| 6,966,081 | B1 * | 11/2005 | Sharps | A61G 7/1046 5/621 |
| 10,154,931 | B1 | 12/2018 | Vann | |
| 10,314,754 | B2 | 6/2019 | Karwal | |
| 2017/0296416 | A1 | 10/2017 | Zouhair | |

FOREIGN PATENT DOCUMENTS

| | | |
|---|---|---|
| EP | 1159947 | 9/2006 |

* cited by examiner

*Primary Examiner* — Fredrick C Conley
(74) *Attorney, Agent, or Firm* — Kyle A. Fletcher, Esq.

(57) ABSTRACT

The adjustable therapist table comprises a first lifting module, a second lifting module, and a brace panel. The brace panel may be coupled to the second lifting module. The brace panel may be coupled to the first lifting module via a hinge. The adjustable therapist table may be adapted to assist an operator in moving a patient during a medical examination or medical procedure. A plurality of air chambers located on the top surface of the first lifting module and on the top surface of the second lifting module may be adapted to inflate and deflate to move the patient in various directions. The second lifting module and the brace panel may be pivoted with respect to the first lifting module via the hinge. As non-limiting examples, a supine patient may be rolled to the left, rolled to the right, and lifted to a sitting position.

17 Claims, 10 Drawing Sheets

ADJUSTABLE THERAPIST TABLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of therapy equipment, more specifically, an adjustable therapist table.

SUMMARY OF INVENTION

The adjustable therapist table comprises a first lifting module, a second lifting module, and a brace panel. The brace panel may be coupled to the second lifting module. The brace panel may be coupled to the first lifting module via a hinge. The adjustable therapist table may be adapted to assist an operator in moving a patient during a medical examination or medical procedure. A plurality of air chambers located on the top surface of the first lifting module and on the top surface of the second lifting module may be adapted to inflate and deflate to move the patient in various directions. The second lifting module and the brace panel may be pivoted with respect to the first lifting module via the hinge. As non-limiting examples, a supine patient may be rolled to the left, rolled to the right, and lifted to a sitting position.

An object of the invention is to move a patient during a therapy session using a plurality of air chambers located on a first lifting module and a second lifting module.

Another object of the invention is to control the inflation and deflation of the plurality of air chambers on an individual lifting module via a plurality of operator controls accessible on a housing of the individual lifting module.

A further object of the invention is to inflate the plurality of air chambers using a plurality of air pumps where an individual; air chamber is coupled to an individual air pump via an individual air hose.

Yet another object of the invention is to couple the first lifting module to the second lifting module via a brace panel and a hinge such that the second lifting module and the brace panel may be pivoted with respect to the first lifting module.

These together with additional objects, features and advantages of the adjustable therapist table will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable therapist table in detail, it is to be understood that the adjustable therapist table is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable therapist table.

It is therefore important that the claims be regarded as including such equivalent construction insofar as they do not depart from the spirit and scope of the adjustable therapist table. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
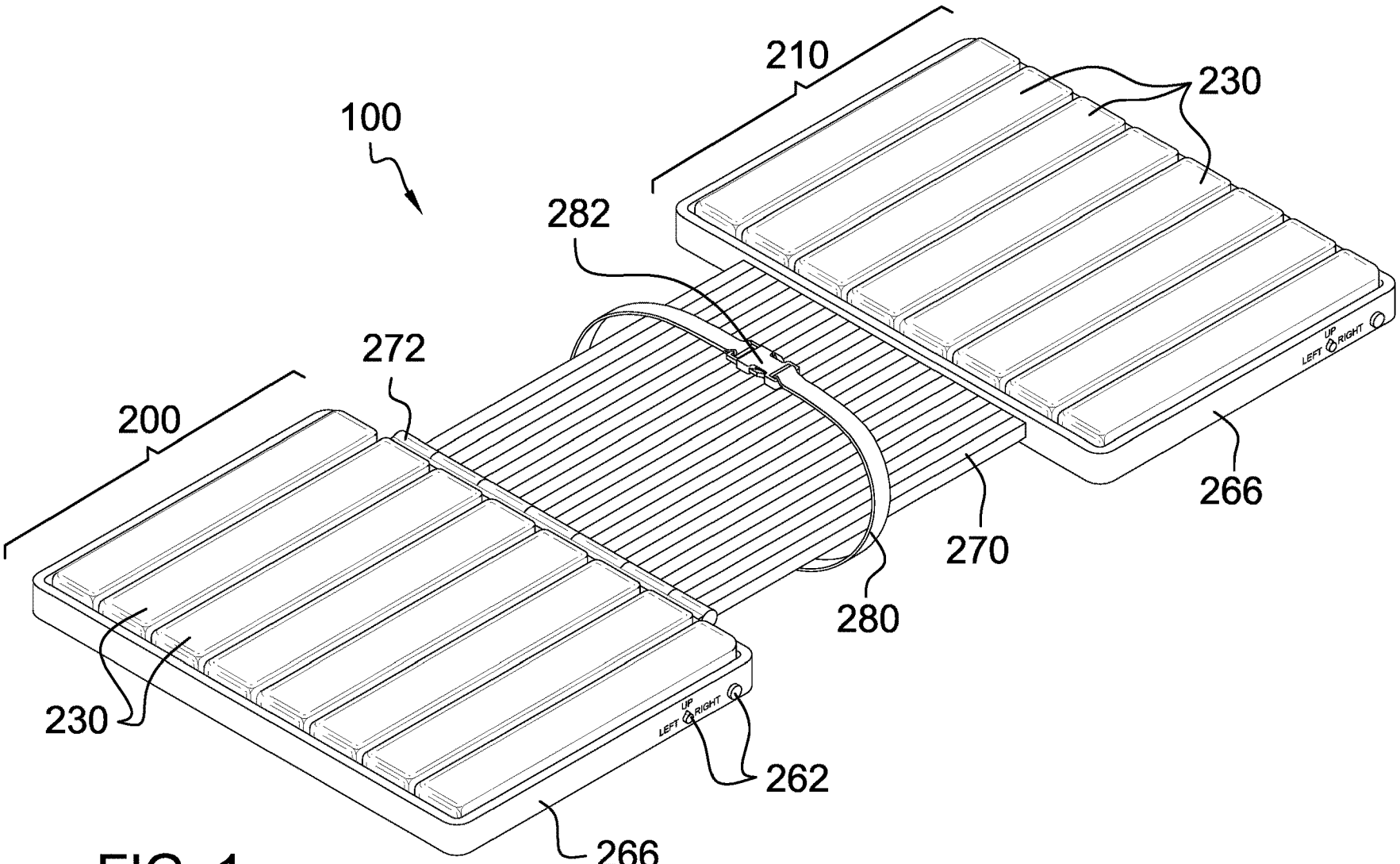
FIG. 1 is an isometric view of an embodiment of the disclosure.
Figure 2:
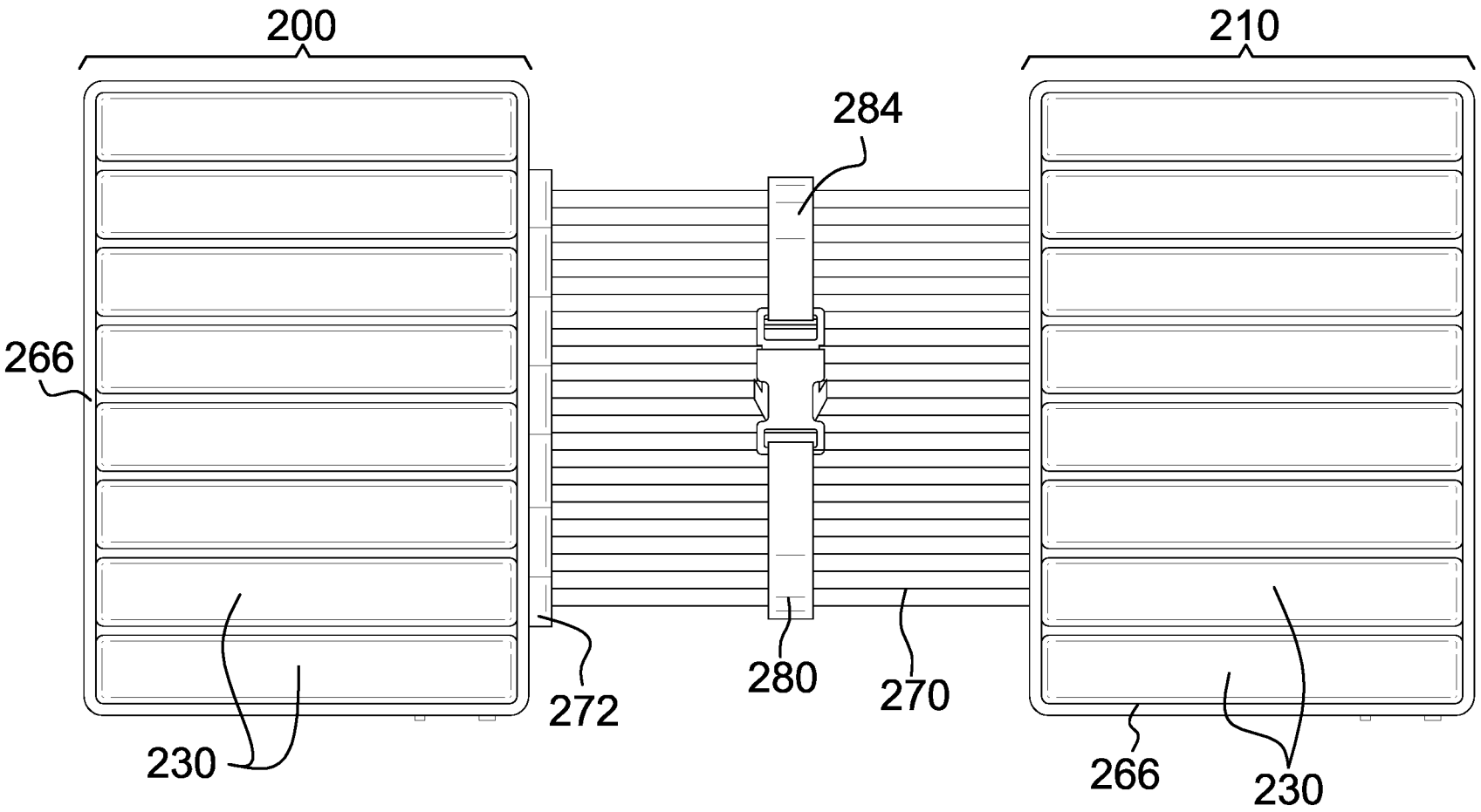
FIG. 2 is a top view of an embodiment of the disclosure.
Figure 3:
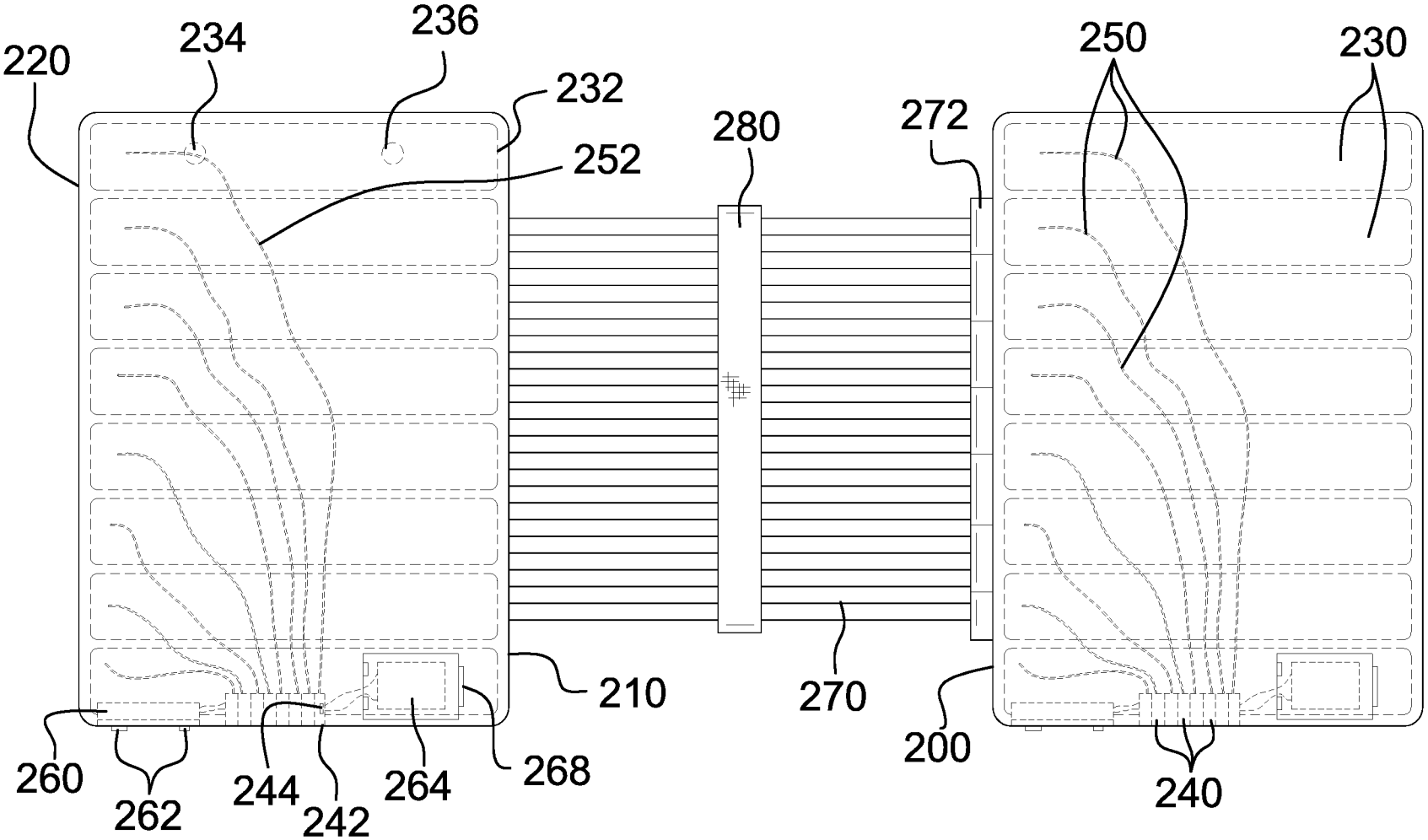
FIG. 3 is a bottom view of an embodiment of the disclosure.
Figure 4:
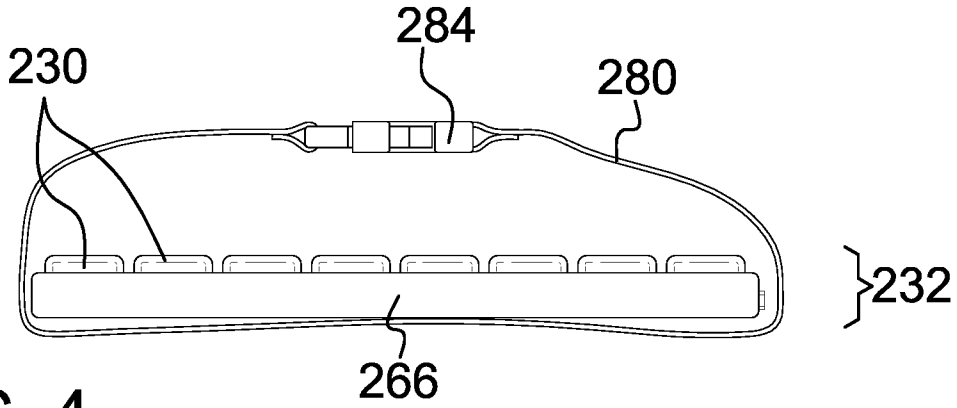
FIG. 4 is an end view of an embodiment of the disclosure.
Figure 5:
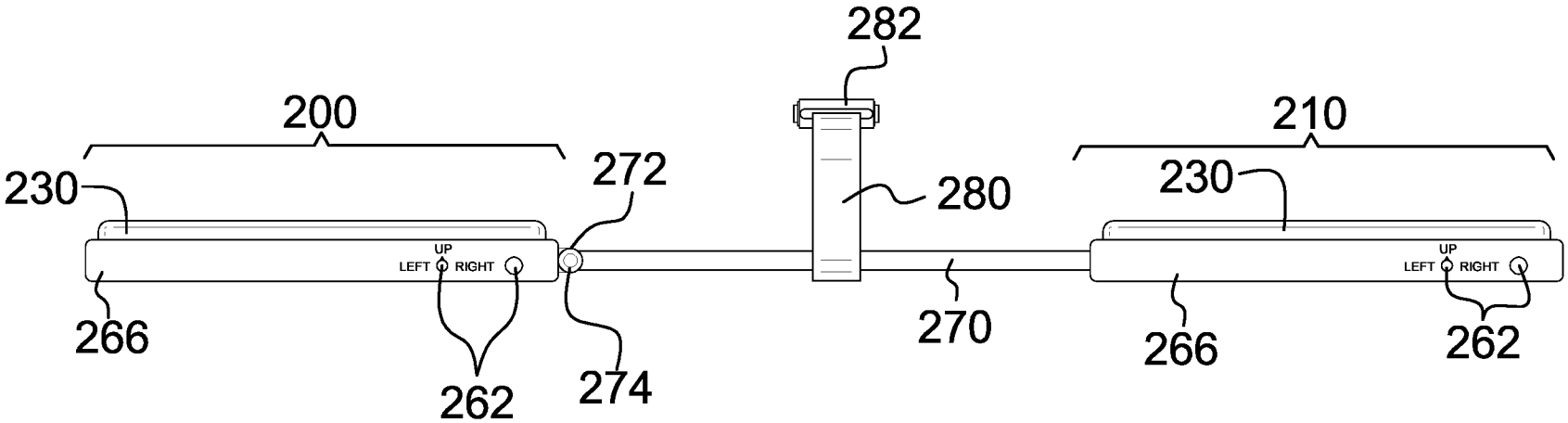
FIG. 5 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Further-more, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 13.

The adjustable therapist table 100 (hereinafter invention) comprises a first lifting module 200, a second lifting module 210, and a brace panel 270. The brace panel 270 may be coupled to the second lifting module 210. The brace panel 270 may be coupled to the first lifting module 200 via a hinge 272. The invention 100 may be adapted to assist an operator in moving a patient 900 during a medical examination or medical procedure. A plurality of air chambers 230 located on the top surface of the first lifting module 200 and on the top surface of the second lifting module 210 may be adapted to inflate and deflate to move the patient 900 in various directions. The second lifting module 210 and the brace panel 270 may be pivoted 296 with respect to the first lifting module 200 via the hinge 272. As non-limiting examples, a supine patient 902 may be rolled to the left 290, rolled to the right 292, and lifted to a sitting position 294.

The first lifting module 200 may be adapted to be placed under a midsection 910 of the patient 900. As a non-limiting example, the first lifting module 200 may be placed under the hips or buttocks of the patient 900. The first lifting module 200 may be adapted to move the midsection 910 of the patient 900 as the plurality of air chambers 230 in the first lifting module 200 are inflated and deflated. The second lifting module 210 may be adapted to be placed under an upper body 920 of the patient 900. As a non-limiting example, the second lifting module 210 may be placed under the head and/or torso of the patient 900. The second lifting module 210 may be adapted to move the upper body 920 of the patient 900 as the plurality of air chambers 230 in the second lifting module 210 are inflated and deflated.

An individual lifting module 220 selected from the first lifting module 200 and the second lifting module 210 may comprise the plurality of air chambers 230, a plurality of air pumps 240, a plurality of air hoses 250, a controller 260, a battery 264, and an enclosure 266. The plurality of air chambers 230 may be accessible on the top surface of the enclosure 266 of the individual lifting module 220. The plurality of air pumps 240, the plurality of air hoses 250, the controller 260, and the battery 264 may be located within the enclosure 266. A plurality of operator controls 262 electrically coupled to the controller 260 may be accessible on a side of the enclosure 266. The battery 264 may be accessible via an access door 268 in the enclosure 266.

An individual air chamber 232 selected from the plurality of air chambers 230 may be an airtight compartment made from an elastomeric material. The individual air chamber 232 may form a rectangular prism when fully inflated. The individual air chamber 232 may flatten to form a rectangular pad when deflated. Intermediate stages of inflation may result in the individual air chamber 232 adopting an irregular shape. As a non-limiting example, if the individual air chamber 232 is 50% inflated the portion of the individual air chamber 232 where the weight of the patient 900 is resting on the individual air chamber 232 may be compressed while the portion of the individual air chamber 232 that is clear of the weight of the patient 900 may be fully expanded. The individual air chamber 232 may be inflated by introducing compressed air into the individual air chamber 232.

The plurality of air pumps 240 provide the compressed air to inflate the plurality of air chambers 230. An individual air pump 242 selected from the plurality of air pumps 240 may take in air at normal atmospheric pressure, compress the air to a pressure higher than normal atmospheric pressure, and expel the compressed air into one of the plurality of air hoses 250. The individual air pump 242 may be electromechanical and may be energized by the application of an electrical potential from the controller 260 to the individual air pump 242.

The plurality of air hoses 250 route the compressed air from the plurality of air pumps 240 to the plurality of air chambers 230. An individual air hose 252 selected from the plurality of air hoses 250 may be uniquely associated with one of the plurality of air pumps 240 and one of the plurality of air chambers 230. One end of the individual air hose 252 may be coupled to the output of the individual air pump 242 and the opposite end of the individual air hose 252 may be coupled to the individual air chamber 232. The individual air hose 252 may pass the compressed air from the individual air pump 242 to the individual air chamber 232. As a non-limiting example, the individual air hose 252 may be coupled to the individual air chamber 232 via an inflation aperture 234 located on the bottom of the individual air chamber 232.

In some embodiments, the individual air chamber 232 may deflate by venting the compressed air through a deflation aperture 236 in the individual air chamber 232. The deflation aperture 236 may constantly leak the compressed air, but at a rate that is slower than the inflation rate of the individual air pump 242. Therefore, as long as the individual air pump 242 is energized the individual air chamber 232 will inflate and when the individual air pump 242 is deenergized the individual air chamber 232 may deflate as the compressed air vents from the individual air chamber 232.

In some embodiments, the individual air chamber 232 may be deflated by deactivating the individual air pump 242 and by allowing the compressed air from the individual air chamber 232 to flow backwards from the individual air chamber 232 to the individual air pump 242 via the individual air hose 252 and to then exit the individual air pump 242 via the intake of the individual air pump 242. In some embodiments, the individual air pump 242 may be operable to close an internal valve 244 to prevent the escape of the compressed air thus allowing the individual air chamber 232 to maintain a constant air pressure within the individual air chamber 232 without running the individual air pump 242.

The controller 260 may control the operation of the individual lifting module 220. The controller 260 may comprise electrical circuitry and/or a microprocessor. The controller 260 may monitor the state of the plurality of operator controls 262 to determine when the plurality of air chambers 230 require inflating or deflating.

The plurality of operator controls 262 may be adapted to be an interface between the operator and the individual lifting module 220. The plurality of operator controls 262 may initiate the energizing and deenergizing of the plurality of air pumps 240 either individually or in groups.

The battery 264 may comprise one or more energy-storage devices. The battery 264 may be a source of electrical energy to operate the controller 260 and the plurality of air pumps 240. The battery 264 may be replaceable or rechargeable.

The brace panel 270 may be a rigid panel that may maintain the distance between the first lifting module 200 and the second lifting module 210. The brace panel 270 may comprise the hinge 272 and a safety strap 280. The brace panel 270 may be coupled to the first lifting module 200 such that the angle between the first lifting module 200 and the brace panel 270 may be changed by the operator. In some embodiments, the hinge 272 may comprise a ratchet 274 such that the hinge 272 may hold an angle until the ratchet 274 is released.

The safety strap 280 may be adapted to retain the patient 900 on the invention 100 by encircling the patient 900 and the brace panel 270. The safety strap 280 may comprise a fastener 282 which may be adapted to release when the patient 900 is being placed onto or removed from the invention 100. The fastener 282 may be adapted to hold the safety strap 280 closed to retain the patient 900. As a non-limiting example, the fastener 282 may be a buckle 284.

Figure 6:
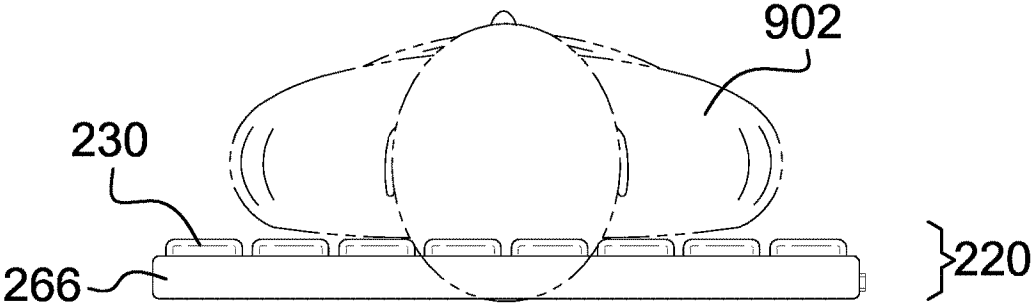
FIG. 6 is an in-use view of an embodiment of the disclosure illustrating a supine patient strapped to the invention.
Figure 8:
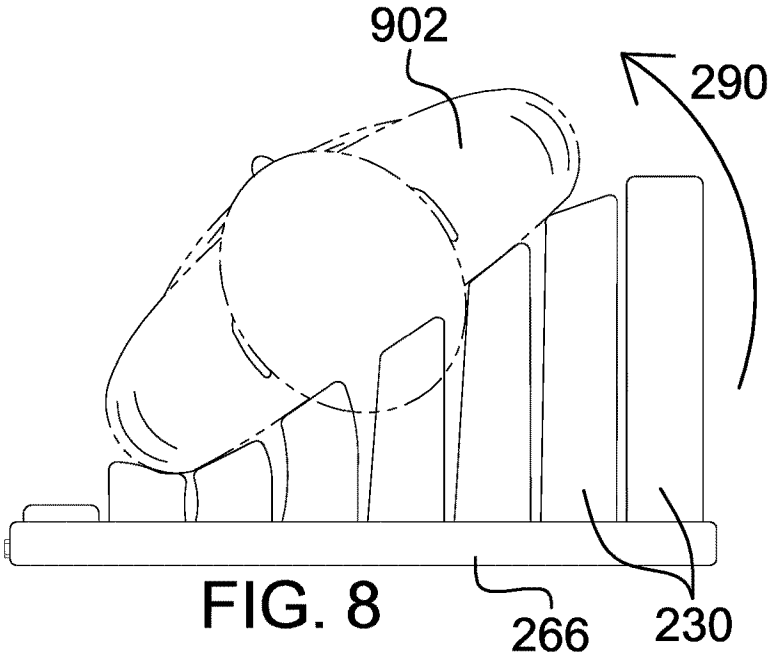
FIG. 8 is an in-use view of an embodiment of the disclosure illustrating the patient being rolled to the left.

As non-limiting examples, the supine patient 902 may be rolled to the left 290 using the invention 100 as shown in FIGS. 6 and 8. Responsive to the activation of one or more of the plurality of operator controls 262, the controller 260 may energize a subset of the plurality of air pumps 240 to inflate the plurality of air chambers 230 on the right side of the patient 900. The plurality of air chambers 230 on the first lifting module 200 and the second lifting module 210 may be inflated and deflated independently of each other by activating the plurality of operator controls 262 on the first lifting module 200 or the second lifting module 210 only. The plurality of air chambers 230 on the first lifting module 200 and the second lifting module 210 may be inflated and deflated at the same time if the plurality of operator controls 262 on both the first lifting module 200 and the second lifting module 210 are activated at the same time.

Figure 7:
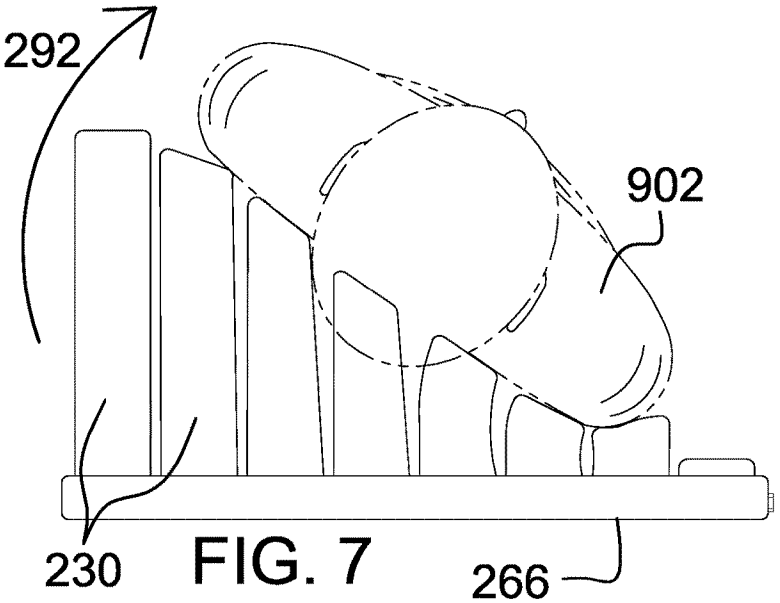
FIG. 7 is an in-use view of an embodiment of the disclosure illustrating the patient being rolled to the right.

As non-limiting examples, the supine patient 902 may be rolled to the right 292 using the invention 100 as shown in FIGS. 6 and 7. Responsive to the activation of one or more of the plurality of operator controls 262, the controller 260 may energize a subset of the plurality of air pumps 240 to inflate the plurality of air chambers 230 on the left side of the patient 900.

The patient 900 may be lowered back into a supine position by deflating the plurality of air chambers 230.

Figure 9:
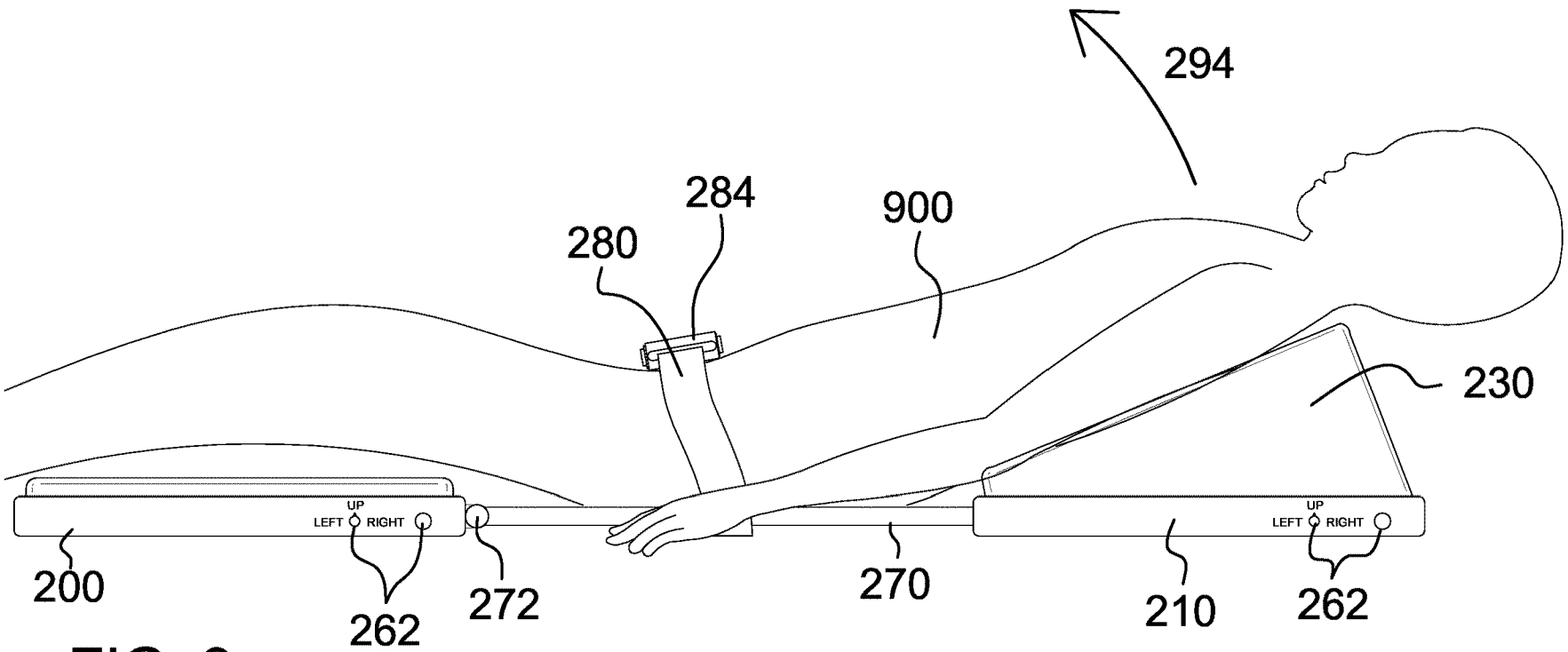
FIG. 9 is an in-use view of an embodiment of the disclosure illustrating the patient being lifted to a seated position.
Figure 10:
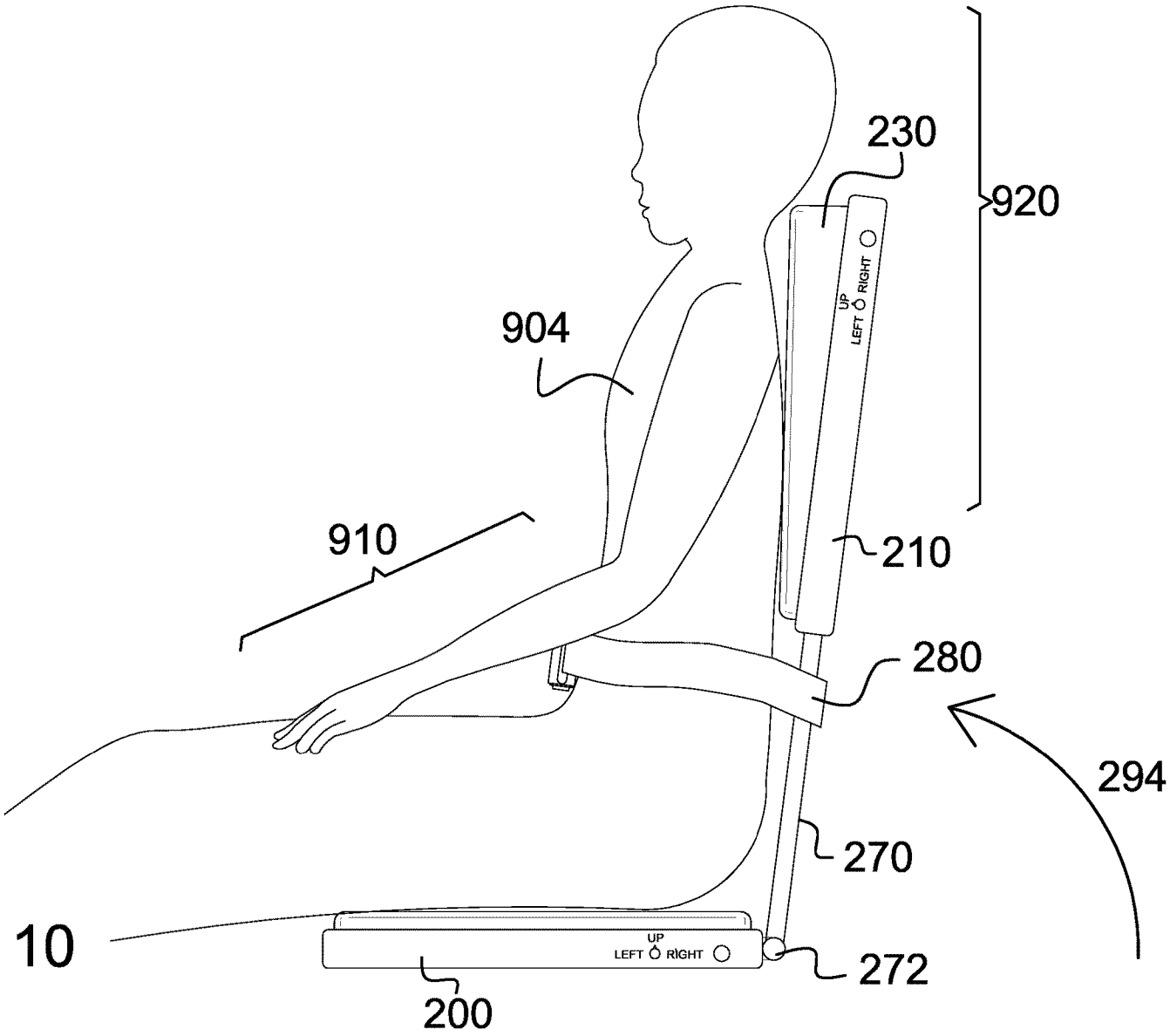
FIG. 10 is an in-use view of an embodiment of the disclosure illustrating the patient being lifted to a seated position.

As a non-limiting example, the patient 900 may be lifted to a sitting position 294 using the invention 100 as shown in FIGS. 9 and 10. The brace panel 270 and the second lifting module 210 may be pivoted 296 with respect to the first lifting module 200 to assist the patient 900 while sitting up. If so equipped, the ratchet 274 in the hinge 272 may prevent the brace panel 270 and the second lifting module 210 from falling backwards. The second lifting module 210 may also be partially inflated to incline the upper body 920.

Figure 12:
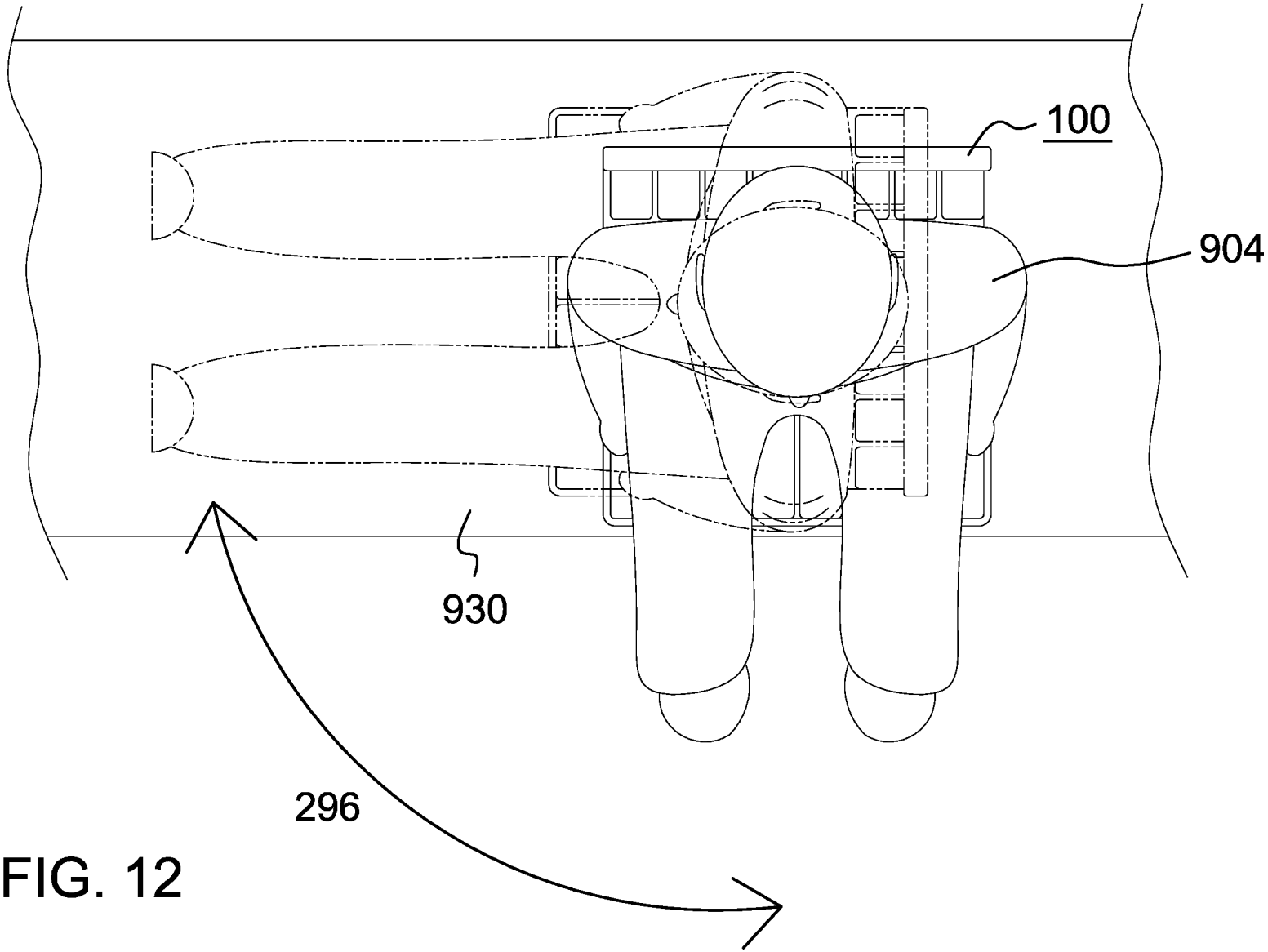
FIG. 12 is an in-use view of an embodiment of the disclosure illustrating a seated patient being pivoted to attempt to stand.
Figure 13:
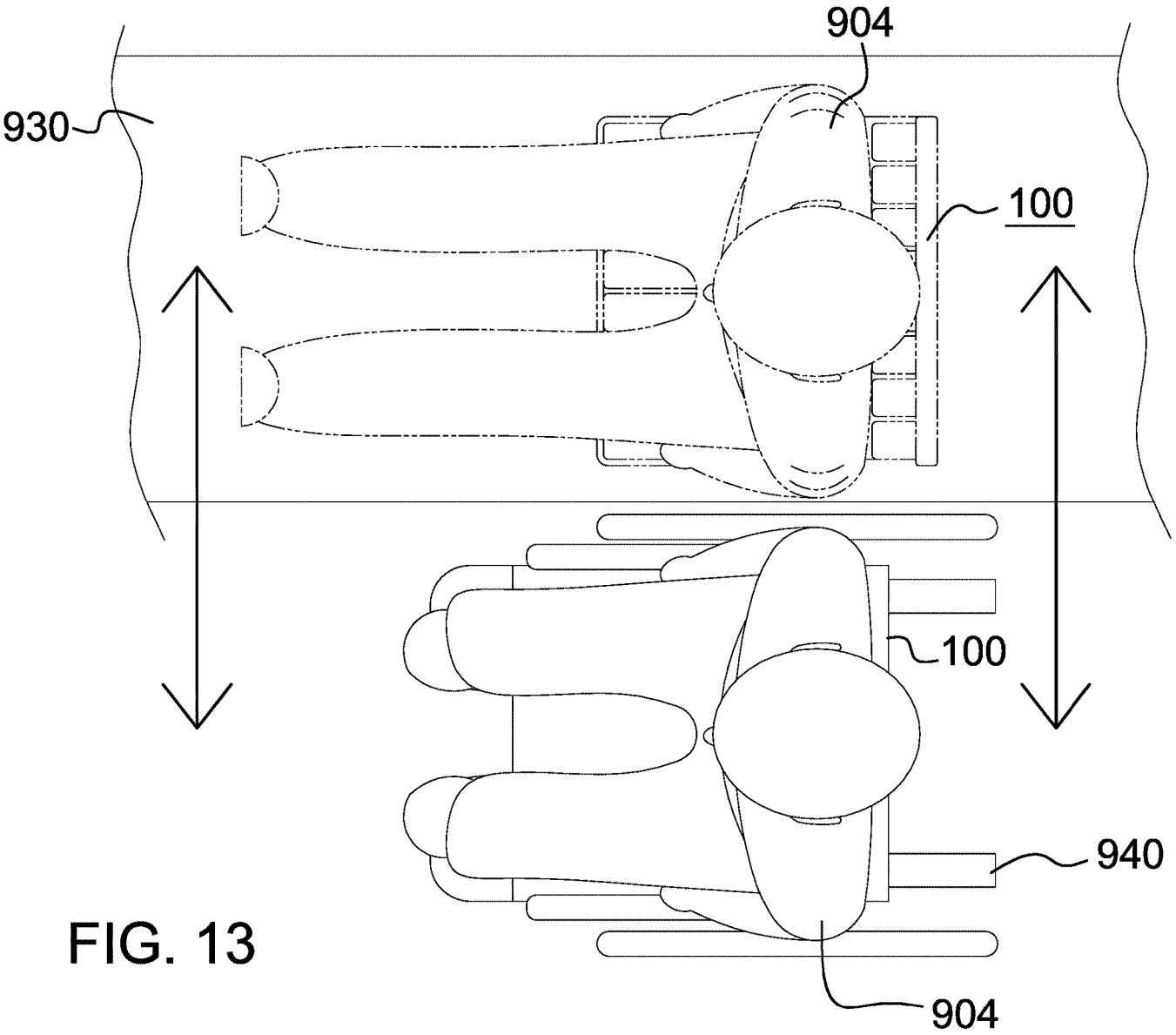
FIG. 13 is an in-use view of an embodiment of the disclosure illustrating a seated patient being moved into a wheelchair.

The invention 100 may be pivoted 296 to allow a seated patient 904 to move to a standing position as shown in FIG. 12. Alternatively, the invention 100 may be moved lateral by medical technicians to place the patient 900 into a different exam table or into a wheelchair 940 as shown in FIG. 13.

Figure 11:
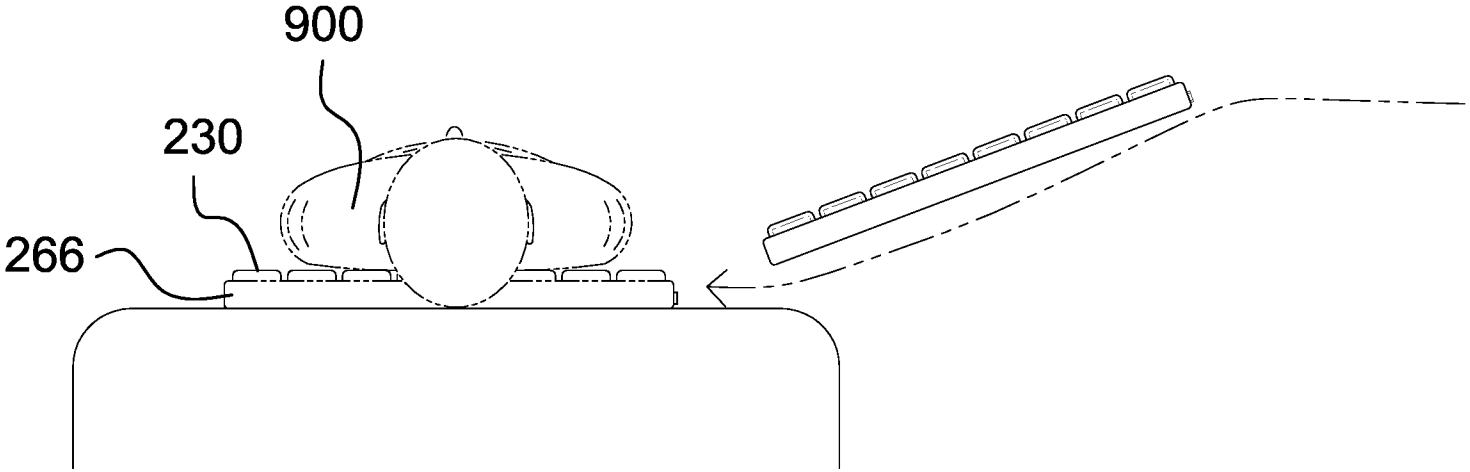
FIG. 11 is an in-use view of an embodiment of the disclosure illustrating the invention being slid under a supine patient.

The invention 100 may be thin enough when deflated that the invention 100 may easily slide under the supine patient 902 as shown in FIG. 11.

In use, the invention 100 may be placed upon an examination table 930 and a supine patient 902 may be place on the top surface of the invention 100. The patient 900 may be rolled to the left 290 or rolled to the right 292 by an operator using the plurality of operator controls 262 to activate the plurality of air chambers 230 on the first lifting module 200, the second lifting module 210, or both as shown in FIGS. 6, 7, and 8. The patient 900 may be lifted to a sitting position 294 via a combination of pivoting the brace panel 270 and the second lifting module 210 with respect to the first lifting module 200 and by partially inflating the plurality of air chambers 230 in the second lifting module 210 as shown in FIGS. 9 and 10. The invention 100 may be pivoted to allow the seated patient 904 to move to a standing position as shown in FIG. 12. Alternatively, the invention 100 may be moved lateral by the medical technicians to place the patient 900 into a different exam table or into a wheelchair 940 as shown in FIG. 13.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "airtight" may refer to a container or seal that is impermeable to air.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, the word "buckle" may refer to any fastener that is used for joining a first loose end of a strap to a second loose end of the same strap or to a loose end of a different strap.

In this disclosure, "compressed air" may refer to air that has been compressed to a pressure greater than atmospheric pressure.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used in this disclosure, a "door" may be a movable or removable barrier that is attached to the wall of a room or the surface of a container for the purpose of allowing or preventing access through an aperture into the room or container.

As used in this disclosure, "elastic" may refer to a material or object that deforms when a force is applied to stretch or compress the material and that returns to its relaxed shape after the force is removed. A material that exhibits these qualities is also referred to as an elastomeric material.

As used herein, "energize" and/or "energization" may refer to the application of an electrical potential to a system or subsystem.

As used in this disclosure, a "fastener" may be a device that is used to join or affix two objects. Fasteners may generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hinge" may be a device that permits the turning, rotating, or pivoting of a first object relative to a second object.

As used herein, the word "hose" may include hoses, tubing, piping, and other conduits capable of directing a flow of a gas or a liquid. When referring to a hose in this disclosure, the terms inner diameter and outer diameter are used as they would be used by those skilled in the plumbing arts.

As used in this disclosure, the term "intermediate" may refer to a location that lies between a first object and a second object As used herein, "irregular" may be descriptive of a physical property which cannot be described as linear, circular, planar, or conforming to the shape of a regular 2D or 3D polygon. As non-limiting examples, the physical property may be an outline shape, a placement pattern, spacings, heights, or combinations thereof. As a non-limiting example, irregular may be synonymous with random or pseudo-random.

As used in this disclosure, the word "lateral" may refer to the sides of an object or movement towards a side. Lateral directions are generally perpendicular to longitudinal directions. "Laterally" may refer to movement in a lateral direction.

As used in this disclosure, a "patient" may be a person who is designated to receive a medical treatment, therapy, or service. The term patient may be extended to an animal when used within the context of the animal receiving veterinary treatment or services As used in this disclosure, a "prism" may be a 3 dimensional geometric structure wherein the form factor of two faces of the prism are congruent and the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used herein, "prone" may refer to a horizontal position where the dorsal side is up and the ventral side is down and "supine" may refer to a horizontal position where the dorsal side is down and the ventral side is up. As non-limiting examples, a person lying on their stomach is in a prone position and a person lying on their back is in a supine position.

As used in this disclosure, a "pump" may be a mechanical or electromechanical device that uses suction or pressure to raise or move fluids, compress fluids, or force a fluid into an inflatable object. As non-limiting examples, fluids may include both liquids, such as water, and gases, such as air.

As used in this disclosure, a "ratchet" may be a device comprising a pawl or hinged catch that engages the sloping teeth of a wheel or bar permitting motion in one direction only. A "ratcheting mechanism" may be a device that incorporates a ratchet. "Ratcheting motion" may refer to motion along a ratcheting mechanism.

As used herein, "rigid" may refer to an object or material which is inflexible. A rigid object may break if force is applied to the object.

As used in this disclosure a "strap" may be a strip of leather, cloth, nylon, plastic, thin metal, rubber, or other flexible material, that is used to fasten, secure, carry, or hold onto something. A strap is sometimes used in conjunction with a buckle.

As used in this disclosure, a "valve" may be a device that is used to control the flow of a fluid, either gas or liquid, through a pipe or to control the flow of a fluid into and out of a container. Some valves may have multiple ports and may allow the diverting or mixing of fluids.

As used in this disclosure, a "wheelchair" may be a chair fitted with four wheels and used for transporting a patient. The wheelchair is commonly used for sick or disabled persons.

With respect to the above description, it is to be realized that the optimum dimensional relationship for the various components of the invention described above and in FIGS. 1 through 13, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An adjustable therapist table comprising:

a first lifting module, a second lifting module, and a brace panel;

wherein the brace panel is coupled to the second lifting module;

wherein the brace panel is coupled to the first lifting module via a hinge;

wherein the adjustable therapist table is adapted to assist an operator in moving a patient;

wherein a plurality of air chambers located on the top surface of the first lifting module and on the top surface of the second lifting module are adapted to inflate and deflate to move the patient;

wherein the second lifting module and the brace panel pivot with respect to the first lifting module via the hinge;

wherein the first lifting module is adapted to be placed under a midsection of the patient;

wherein the first lifting module is adapted to move the midsection of the patient as the plurality of air chambers in the first lifting module are inflated and deflated;

wherein the second lifting module is adapted to be placed under an upper body of the patient;

wherein the second lifting module is adapted to move the upper body of the patient as the plurality of air chambers in the second lifting module are inflated and deflated;

wherein an individual lifting module selected from the first lifting module and the second lifting module comprises the plurality of air chambers, a plurality of air pumps, a plurality of air hoses, a controller, a battery, and an enclosure;

wherein the plurality of air chambers are accessible on the top surface of the enclosure of the individual lifting module;

wherein the plurality of air pumps, the plurality of air hoses, the controller, and the battery are located within the enclosure;

wherein a plurality of operator controls electrically coupled to the controller are accessible on a side of the enclosure;

wherein the battery is accessible via an access door in the enclosure.

2. The adjustable therapist table according to claim 1 wherein an individual air chamber selected from the plurality of air chambers is an airtight compartment made from an elastomeric material;

wherein the individual air chamber forms a rectangular prism when fully inflated;

wherein the individual air chamber flattens to form a rectangular pad when deflated;

wherein intermediate stages of inflation result in the individual air chamber adopting an irregular shape;

wherein the individual air chamber is inflated by introducing compressed air into the individual air chamber.

3. The adjustable therapist table according to claim 2 wherein the plurality of air pumps provide the compressed air to inflate the plurality of air chambers;

wherein an individual air pump selected from the plurality of air pumps takes in air at normal atmospheric pressure, compresses the air to a pressure higher than normal atmospheric pressure, and expels the compressed air into one of the plurality of air hoses;

wherein the individual air pump is electromechanical and is energized by the application of an electrical potential from the controller to the individual air pump.

4. The adjustable therapist table according to claim 3 wherein the plurality of air hoses route the compressed air from the plurality of air pumps to the plurality of air chambers;

wherein an individual air hose selected from the plurality of air hoses is uniquely associated with one of the plurality of air pumps and one of the plurality of air chambers;

wherein one end of the individual air hose is coupled to the output of the individual air pump and the opposite end of the individual air hose is coupled to the individual air chamber;

wherein the individual air hose passes the compressed air from the individual air pump to the individual air chamber.

5. The adjustable therapist table according to claim 4 wherein the individual air hose is coupled to the individual air chamber via an inflation aperture located on the bottom of the individual air chamber.

6. The adjustable therapist table according to claim 4 wherein the individual air chamber deflates by venting the compressed air through a deflation aperture in the individual air chamber.

7. The adjustable therapist table according to claim 4 wherein the individual air chamber is deflated by deactivating the individual air pump and by allowing the compressed air from the individual air chamber to flow backwards from the individual air chamber to the individual air pump via the individual air hose and to then exit the individual air pump via the intake of the individual air pump.

8. The adjustable therapist table according to claim 7 wherein the individual air pump is operable to close an internal valve to prevent the escape of the compressed air thus allowing the individual air chamber to maintain a constant air pressure within the individual air chamber without running the individual air pump.

9. The adjustable therapist table according to claim 4 wherein the controller controls the operation of the individual lifting module;

wherein the controller comprises electrical circuitry and/or a microprocessor;

wherein the controller monitors the state of the plurality of operator controls to determine when the plurality of air chambers require inflating or deflating.

10. The adjustable therapist table according to claim 9 wherein the plurality of operator controls are adapted to be an interface between the operator and the individual lifting module;

wherein the plurality of operator controls initiate the energizing and deenergizing of the plurality of air pumps either individually or in groups.

11. The adjustable therapist table according to claim 10 wherein the battery comprises one or more energy-storage devices;

wherein the battery is a source of electrical energy to operate the controller and the plurality of air pumps;

wherein the battery is replaceable or rechargeable.

12. The adjustable therapist table according to claim 11 wherein the brace panel is a rigid panel that maintains the distance between the first lifting module and the second lifting module;

wherein the brace panel comprises the hinge and a safety strap;

wherein the brace panel is coupled to the first lifting module such that the angle between the first lifting module and the brace panel is changeable.

13. The adjustable therapist table according to claim 12 wherein the hinge comprises a ratchet such that the hinge holds an angle until the ratchet is released.

14. The adjustable therapist table according to claim 12 wherein the safety strap is adapted to retain the patient on the adjustable therapist table by encircling the patient and the brace panel;

wherein the safety strap comprises a fastener which is adapted to release when the patient is being placed onto or removed from the adjustable therapist table;

wherein the fastener is adapted to hold the safety strap closed to retain the patient.

15. The adjustable therapist table according to claim 14 wherein the fastener is a buckle.

16. The adjustable therapist table according to claim 14 wherein the plurality of air chambers on the first lifting module and the second lifting module are inflated and deflated independently of each other by activating the plurality of operator controls on the first lifting module or the second lifting module only.

17. The adjustable therapist table according to claim 16 wherein the plurality of air chambers on the first lifting module and the second lifting module are inflated and deflated at the same time if the plurality of operator controls on both the first lifting module and the second lifting module are activated at the same time.

* * * * *